United States Patent [19]

Miner

[11] Patent Number: 4,578,291

[45] Date of Patent: Mar. 25, 1986

[54] WIND RESPONSIVE ADJUSTABLE DECORATIVE DEVICE

[75] Inventor: Jon Miner, Arden Hills, Minn.

[73] Assignee: Internatural Designs, Inc., Minneapolis, Minn.

[21] Appl. No.: 681,642

[22] Filed: Dec. 14, 1984

[51] Int. Cl.[3] ..... B44C 3/06

[52] U.S. Cl. ..... 428/8; 272/8 D; 428/542.2; 446/487

[58] Field of Search ..... 428/8, 12, 18, 542.2; 272/8 D; 273/DIG. 24; 434/302; 446/487

[56] References Cited

U.S. PATENT DOCUMENTS

| | | | |
|---|---|---|---|
| 2,041,481 | 5/1936 | Otar | 428/542.2 X |
| 2,466,176 | 4/1949 | Kunisch | 428/542.2 X |
| 3,503,832 | 3/1970 | Umminger, Jr. | 428/542.2 X |
| 4,186,503 | 2/1980 | Fontana | 428/18 X |
| 4,286,780 | 9/1981 | Vermeire | 428/8 X |
| 4,380,562 | 4/1983 | Bream | 428/8 |
| 4,417,725 | 11/1983 | Van Horn | 434/302 X |
| 4,428,988 | 1/1984 | Adinamis | 428/8 |

FOREIGN PATENT DOCUMENTS

| | | | |
|---|---|---|---|
| 246621 | 1/1961 | Australia | 428/18 |

*Primary Examiner*—Henry F. Epstein
*Attorney, Agent, or Firm*—James R. Cwayna

[57] ABSTRACT

A decorative device for hanging in and revolving in the wind to create a pleasant effect. The device has a number of slats of selected material mounted for arcuate positioning with respect to one another on a longitudinally extending strut also serves as a hanging device. The slats are rotatable on the strut and are held thereon in such a manner to provide positioning and holding friction between adjacent slats which allows the arcuate positioning of one slat to another to provide for the creation of a spiral design of any desired lead or pitch. By coloring selected areas of the slats while they are in a flat, unformed position, a particular decorative effect is obtained when the spiral is formed.

5 Claims, 3 Drawing Figures

WIND RESPONSIVE ADJUSTABLE DECORATIVE DEVICE

FIELD OF THE INVENTION

This invention relates generally to decorative devices for mounting in a wind current and which will revolve in such current to give a pleasant, comforting effect to a viewer.

BRIEF SUMMARY OF THE INVENTION

A decorative device which is designed for placement in a wind current where it will revolve. The device includes a longitudinally extending strut upon which a number of radially extending elements such as slats are rotatably mounted with means on a lower end of the strut to exert a longitudinal force against the lower of the slats to provide a friction force therebetween such that the slats may be arcuately positioned with respect to one another such that a relatively smooth spiral may be formed thereby. A universal mounting element is provided on the upper end of the strut to permit the same to be attached to a support member for hanging and allow the device to rotate thereund.

The device, though of spiral shape in its formed design, is foldable to and from a flat position wherein all slats are aligned. The flat position accommodates the application of paint or other decoration to the slats and also facilitates shipping with a minimum volume.

BACKGROUND AND OBJECTS OF THE INVENTION

The device provided herein is new and unique in several particular aspects. Wind devils, wind spirals and similar devices by similar names are well known to the art and the applicant is fully aware of the devices being sold but, only in their formed spiral, immovable condition. Many such units are available which are formed from slats of wood glued into the spiral shape and stained or painted for decorative effect.

Obviously, such a formed unit is costly to ship and, obviously, it is difficult, at the least, to redecorate or initially decorate such a formed article. With the applicant's concepts the unit is shippable in a flat, unformed condition and the unit may be decorated or redecorated in a flat condition. The applicant's concept also permits a user to alter the shape of the spiral or, if desired, to form the slats into other than a true spiral shape.

It is therefore an object of the applicant's invention to provide a wind responsive unit which is formed from a number of side-by-side flat, slat elements which elements may be arcuately shifted with respect to one another and held in a desired position to achieve a decorative shape which will move in response to wind currents.

It is a further object of the applicant's invention to provide a new and unique method for the formation of a wind responsive decorative device which includes a mounting strut with a number of adjacent slats arranged thereon which slats are arcuately shiftable and positionable with respect to one another with means to secure the slats in the final, shifted condition and position.

It is still a further object of the applicant's invention to provide a unit for the formation of a wind responsive, decorative device which may be decorated in a flat condition and thereafter shifted to modify the final decorative form thereof.

These and other objects and advantages of the applicant's invention will more fully appear from a consideration of the accompanying description made in association with the accompanying drawings.

PREFERRED EMBODIMENT OF THE INVENTION

Figure 1:
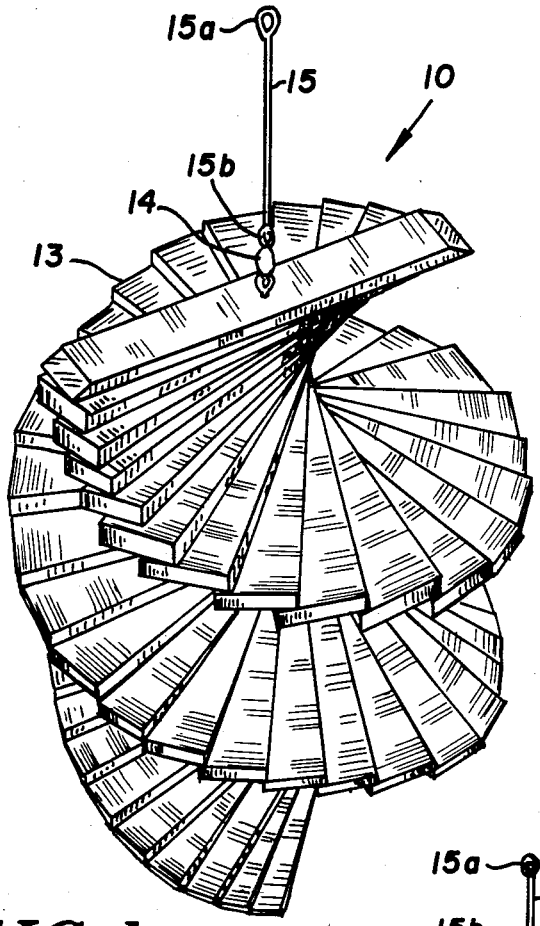
FIG. 1 is a perspective view of a wind responsive device formed in spiral position and embodying the concepts of the applicant's invention.
Figure 2:
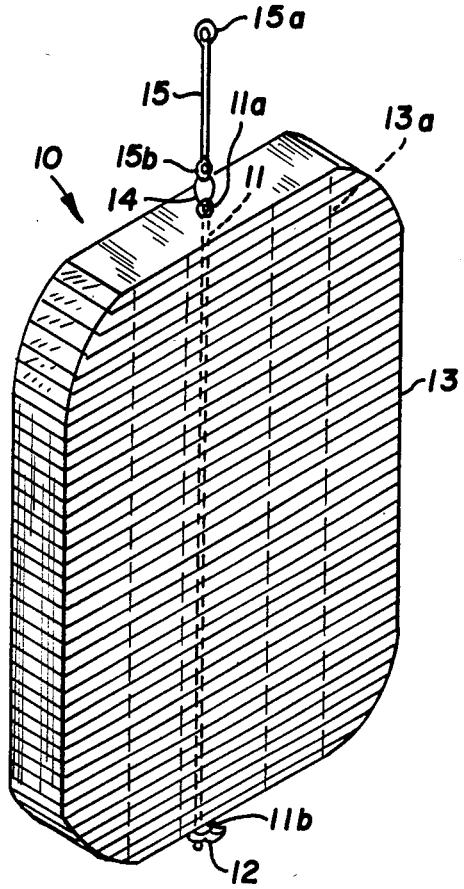
FIG. 2 is a perspective view of the device of the invention illustrating the same in flat condition.
Figure 3:
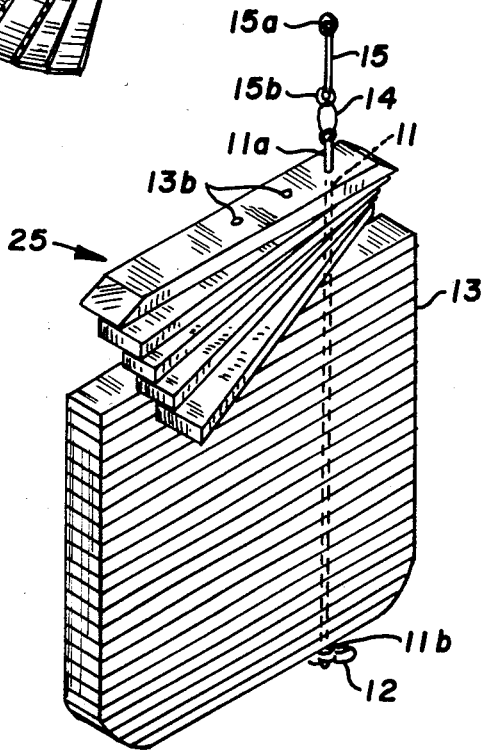
FIG. 3 is a view similar to FIG. 2 illustrating a modified form of the invention which will provide a different formed shape of the formed unit.

In accordance with the accompanying drawings, the wind responsive unit embodying the concepts of the applicant's invention is generally designated 10 and is illustrated in its spirally formed shape in FIG. 1 and in a flat, what may be termed shipping or decorating shape in FIG. 2. A modified form of the invention is illustrated in FIG. 3 and the unit is designated 25 therein.

A first longitudinally extending member 11, such as a metal rod is provided with one end 11*a* providing a connecting eye and the opposite end 11*b* providing threads for the securing of a wing nut 12 or the like thereto such that pressure may be exerted by the wing nut 12 longitudinally of the rod 11 to provide a friction force against slat elements that are arranged on the rod 11. The individual slat elements are designated 13.

The slat elements 13 are normally provided of a relatively thin cross section of a predetermined thickness and width with a uniform length over at least a number of such slats 13. Obviously, the specific dimensions of the slats 13 may be varied even though the applicant has elected to illustrate all of such slats 13 being commonly formed with a minimal radius on selected slats 13 to provide a rounded effect to the formed unit. With such a flat design for the slats and all of the slats being of a common width, the unit will, when in a collapsed position, provide a flat surface for ease of decorating.

Slats 13 may be formed of a wide selection of materials. The units which commonly are available on the market are of wood but, as stated, these units are sold in their preformed spiral shape. Applicant has stated that the slats 13 are formed into the desired shape and upon tightening of wing nut 12, are held to each other by friction. The only requirement for the slats then is that they must be capable of retaining their shape under a minimal pressure load and possess some friction qualities.

Decorating may take a simple form such as defined by the dotted lines 13*a* on the face of the slats 13. Upon shaping, a unique design is achieved even with this simplicity.

A universal bearing 14 is provided at the eye end 11*a* of rod 11 and a hanger rod or the like extends therefrom for mounting of the unit. This hanger rod 15 may be flexible or rigid and includes an attachment end 15*a* with the other end 15*b* being attached to the bearing 14.

A modified form of the invention is illustrated in FIG. 3. In this form of the invention, a plurality of or a selected number of passages 13*b* may be formed through slats 13. These passages 13*b*, being formed through all the slats 13 will permit the user to form any number of designs only limited by the user's imagination.

The use of the unit should be obvious through this description. A standard spiral shape may be formed with the unit as shown in FIGS. 1 and 2, or the user may elect other than a spiral, with the possibilities of formed shapes being increased with the modifications of FIG. 3 with all being included in the concepts of the invention.

It should be obvious that the applicant has provided a new and unique structure and structurally adjustable unit for the formation of wind responsive, decorative devices.

What I claim is:

1. The structure for formation of a decorative wind responsive device including:

a. a longitudinally extending mounting rod;

b. stop means on one end of said rod;

c. a plurality of slat members of generally rectangular cross section each having a passage therethrough generally intermediate the ends thereof and extending through the lesser dimension thereof received onto and arranged for rotation about said rod arranged to extend radially outwardly from said rod;

d. means on the other end of said rod and longitudinally moveable therealong to provide a frictional holding force to said slats whereby the slats are moveable with respect to one another and held in selected position thereby; and, e. universal rotation means arranged adjacent said stop means including mounting means whereby said rod and positioned slats may be suspended in a wind area for free movement in response to wind currents.

2. The structure set forth in claim 1 and said friction applying means including a threaded rod end and a threaded fastener therefore.

3. The structure set forth in claim 1 and said slat members each including at least a pair of rod receiving passages spaced longitudinally thereof.

4. The structure set forth in claim 1 and the cross sectional width of said slats being selected to provide a generally flat surface when the slats are in a collapsed position.

5. The structure set forth in claim 1 and said slats being formed of a material allowing decorating thereof.

* * * * *